US007128289B2

(12) United States Patent
Perini

(10) Patent No.: US 7,128,289 B2
(45) Date of Patent: Oct. 31, 2006

(54) AUTOMATIC DRIVE APPARATUS FOR REEL REPLACEMENT IN MACHINES FOR THE PRODUCTION OF REELS OF PAPER AND THE LIKE

(75) Inventor: Fabio Perini, Viareggio-Lucca (IT)

(73) Assignee: FOCUS S.R.L. societa unipersonale (IT)

( * ) Notice: Subject to any disclaimer, the term of this patent is extended or adjusted under 35 U.S.C. 154(b) by 0 days.

(21) Appl. No.: 11/182,180

(22) Filed: Jul. 11, 2005

(65) Prior Publication Data

US 2006/0032966 A1 Feb. 16, 2006

Related U.S. Application Data

(63) Continuation of application No. PCT/IT04/06649, filed on Nov. 25, 2004.

(30) Foreign Application Priority Data

Dec. 1, 2003 (IT) ..... FI2003A302

(51) Int. Cl.
*B65H 19/28* (2006.01)

(52) U.S. Cl. ..... 242/532.2; 242/542.3; 162/193

(58) Field of Classification Search ..... 242/532.2, 242/532.3, 532.7, 527.2, 542.3, 526, 526.3, 242/521, 908; 162/193
See application file for complete search history.

(56) References Cited

U.S. PATENT DOCUMENTS

| | | | | |
|---|---|---|---|---|
| 4,056,918 | A | 11/1977 | Matsumoto | 53/118 |
| 4,196,865 | A * | 4/1980 | Patriksson | 242/521 |
| 4,678,133 | A | 7/1987 | Suzuki | 242/56 A |
| 5,673,870 | A | 10/1997 | Fielding et al. | 242/542.3 |
| 6,029,927 | A * | 2/2000 | Wohlfahrt et al. | 242/527.2 |
| 6,474,589 | B1 * | 11/2002 | Enwald et al. | 242/527.2 |
| 6,581,868 | B1 | 6/2003 | Enwald et al. | 242/521 |

* cited by examiner

*Primary Examiner*—Kathy Matecki
*Assistant Examiner*—William E. Dondero
(74) *Attorney, Agent, or Firm*—McGlew & Tuttle, PC

(57) ABSTRACT

An apparatus for reel replacement in machines for the production of reels of light-weight web material, of a type with a device for winding material onto a tubular core or rod and a device for feeding an unloaded rod (spool) intended to replace the reel. The apparatus has a surface (80) able to delimit, in cooperation with the surface of an unloaded rod (51), a channel (85) to which a jet of air produced by a plurality of nozzles (9) is directed.

9 Claims, 7 Drawing Sheets

AUTOMATIC DRIVE APPARATUS FOR REEL REPLACEMENT IN MACHINES FOR THE PRODUCTION OF REELS OF PAPER AND THE LIKE

CROSS REFERENCE TO RELATED APPLICATION

This is a continuation in part of and claims the benefit (35 U.S.C. §120 and 365(c)) of copending International Application PCT/IT2004/000649 of Nov. 25, 2004, which designated inter alia the United States and which claims the priority of Italian Application FI2003A302 of Dec. 1, 2003. The entire contents of each application is hereby incorporated by reference in its entirety.

FIELD OF THE INVENTION

The present invention concerns an automatic drive apparatus for reel replacement in machines for the production of reels of paper and other light-weight web materials.

BACKGROUND OF THE INVENTION

Machines for the production of reels of crepe paper, smooth paper and other light-weight web materials such as nonwoven fabrics, are known to comprise a so-called "winder" apparatus, which makes it possible to form reels of materials having a preset diameter and comprising a tubular core, usually named "rod" or "spool" onto which the material is wound upon forming each reel. The winder is essentially made up of a motorized cylinder with horizontal axis. The winding of the material during the formation of the reel is ensured by keeping the latter in contact with the surface of said cylinder: the axis of rotation of the reel, that is, of the respective rod, is parallel to the axis of rotation of the winding cylinder. To allow a continuous contact between the winding cylinder and the reel in the course of formation, that is, the "growing" reel, the rod of the latter is engaged to corresponding supports which are mounted horizontally movable on a support structure facing the material-feeding area. Upon completion of a reel, provision is made for moving it away and replacing it with an unloaded rod that is, with a spool. This is previously driven into rotation about its longitudinal axis, so that the peripheral speed of any surface point thereof is equal to the material-feeding speed. To this end, the unloaded rod is supported by two arms located at the two ends of the winding cylinder and movable from and to the area immediately downstream of the same cylinder. When replacing a reel, the arms move the unloaded rod from a position overhanging the winding cylinder to a position of surface contact with the same cylinder, and the unloaded rod is driven into rotation. When the material begins winding up over the thus positioned rod, the arms move the latter to the position previously taken by the just completed reel which is moved away from its position, and the paper web breaks the moment it begins winding up over the new rod.

Upon the replacement of a reel it is possible that the web fails winding up on the unloaded rod, so that the formation of the reel is to be interrupted to start again the winding operation. This has a consequent loss of production and considerable economic damages; moreover, the replacement operation is largely dependent on the skill of the operator in the charge thereof.

SUMMARY OF THE INVENTION

The main object of the present invention is to overcome the drawback, that is, to optimize and facilitate the replacement operation.

According to the invention, an apparatus for reel replacement in a machine for the production of reels of light-weight web material is provided. The apparatus comprises a means for winding material onto a tubular core or rod and means for feeding an unloaded rod intended to replace the reel. The apparatus includes a surface able to delimit, in cooperation with the surface of an unloaded rod a channel to which a jet of air produced by a plurality of nozzles is directed.

The present invention makes it possible to control with far greater accuracy the path covered by the web upon the reel replacement, as well as to increase the production speed without relying on particularly skilled or qualified personnel supervising this operation. Besides, an apparatus according to the present invention is relatively simple to make, cost-effective and reliable also after a prolonged service life.

These and other advantages and characteristics of the invention will be best understood by anyone skilled in the art from a reading of the following description in conjunction with the attached drawings given as a practical exemplification of the invention, but not to be considered in a limiting sense. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
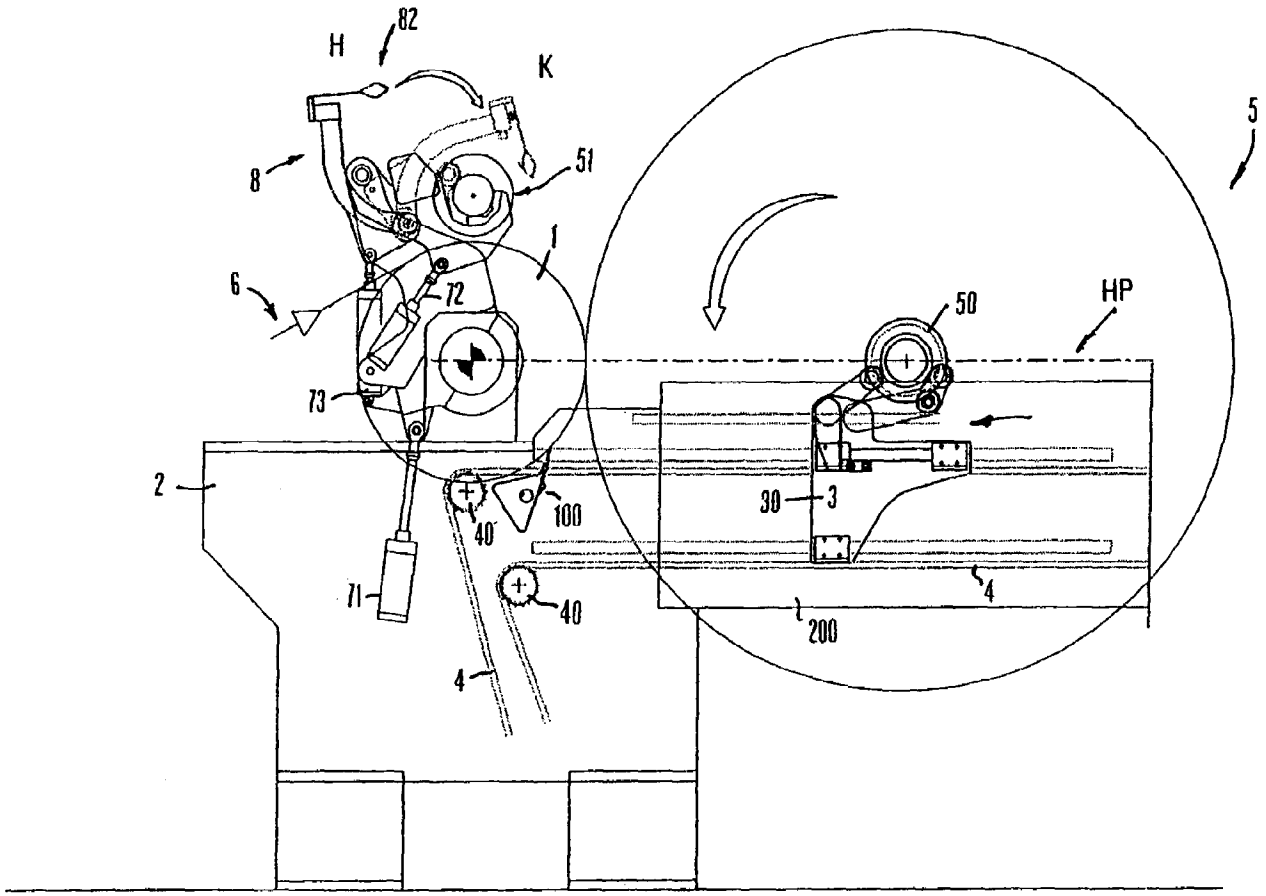
FIG. 1 is a schematic side view in phantom of an apparatus according to the invention, in a rest or stand-by condition.

Reduced to its basic structure, and reference being made to the figures of the attached drawings, an apparatus according to the present invention can be used within a machine for the production of reels of light-weight web material, such as crepe or smooth paper or nonwoven fabric, the apparatus being of a type comprising a motorized winding cylinder (1) having horizontal axis and mounted on a corresponding fixed structure (2) having also associated therewith more supports or carriages (3) engaged to respective means (4) for the movement thereof from and to the cylinder (1): the carriages (3) are intended to support a reel (5) in the course of formation or "growing" reel. The latter is formed by a web (6) of preset material which winds up over a respective rod (50) disposed on said supports (3) and free to rotate about its longitudinal axis which is parallel to that of cylinder (1). In the example of FIG. 1, the means (4) for driving the supports (3) comprise a chain being loop-closed over a plurality of corresponding ring gears (40) and having supports (3) solid thereto in correspondence of the respective base portions (30), that is, in correspondence of the respective portions (30) opposite to those (having cradle shape with bearing rollers) engaging the rods (51). Provided on each side of the cylinder (1) is an arm (7) for supporting an unloaded rod (51), that is, a rod on which a new reel is to be formed. The arms (7) are hinged to the fixed structure (2), so as to result pivotable about the axis of the winding cylinder (1), and associated with corresponding actuators (71) to allow them to move between a stand-by or resting position—substantially vertical (as shown in FIG. 1), with an unloaded rod (51) disposed above the cylinder (1)—and an inclined position (as in FIG. 2) in correspondence of which the unloaded rod (51) comes in contact with the cylinder (1) and the reel-replacing step begins, and between said inclined position and a substantially horizontal position (as in FIG. 5) in which the longitudinal axes of cylinder (1) and of rod (51) result substantially on a same horizontal plane (HP).

The contact between the cylinder (1) and the unloaded rod (51) causes the rotation of the latter about its longitudinal axis. Such rotation has the function, as described later on, to start winding the web over the rod (51) upon the reel replacement. It is understood that the system for driving the unloaded rod (51) into rotation may be of any suitable type.

The actuators (71) are engaged to the structure (2) by their respective skirts and to the arms (7) by their stems.

Also engaged to arms (7), which will be indicated hereinafter as "primary arms", are two further arms (70) to be referred to as "secondary arms". More in particular, each of said two secondary arms (70) is hinged to a corresponding primary arm (7) and exhibits a front portion shaped as a cradle to receive the axis of rod (51). Moreover, each secondary arm (70) is associated with an actuator (72) which drives it into rotation about the axis of the hinge (700) for connection with the relevant primary arm (7). The hinge (700) connects the upper portion of each primary arm (7) with the rear portion of the relevant secondary arm (70). Each actuator (72) is connected, on one side, to the corresponding primary arm (7) and, on the other, to the relevant secondary arm (70), so as to result interposed therebetween.

Figure 5:
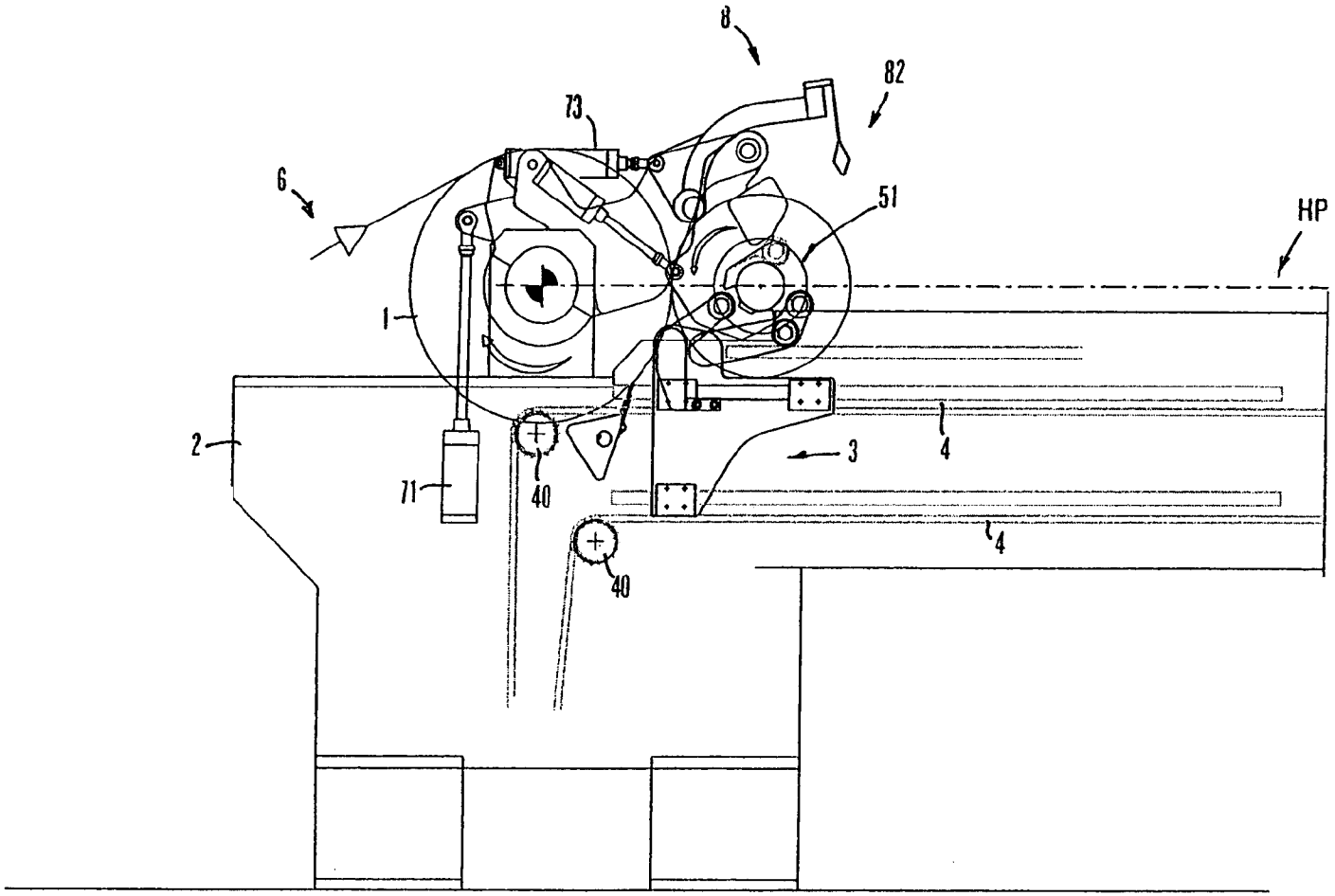
FIG. 5 is a schematic side view in phantom of the apparatus in question, in a condition in which the reel replacement has been completed.

In practice, when the actuators (71) operate the rotation of the primary arms (7) about the axis of cylinder (1), the actuators (72) drive progressively the secondary arms (70) into rotation, so that the trajectory followed by each point of the longitudinal axis of rod (51), upon the passage from the position of FIG. 1 to the position of FIG. 5, is a spiral arc. In this way, during the reel replacement, the growing of the new reel about the rod (51) is allowed and, at the same time, the contact is maintained between the cylinder (1) and the web being reeled over the rod (51).

Advantageously, according to the present invention, associated with said arms (7, 70) is a superstructure (8) having a surface (80) which delimits, in cooperation with the surface of an unloaded rod (51) borne by the same arms (7, 70), a channel (85) (having variable cross-section in the illustrated example) acted upon by an air jet produced by a set of nozzles (9) solid to the same superstructure. The channel in question, and thus the superstructure (8), run throughout the region interested by the presence of the rod.

In particular, reference being made to the exemplary embodiment shown in the figures of the attached drawings, the surface (80) is suitably shaped so as to close also laterally the channel (85) and so that a major section of said channel will result facing the region of formation of the reels (5), the air jet produced by the nozzles (9) being oriented in the opposite direction to lap the underside of surface (80). In relation to this, a vacuum is produced in the space overhanging the unloaded rod (51).

Advantageously, the superstructure (8) is hinged on the two primary arms (7) with a hinge (77) whose axis is parallel to that of the winding cylinder (1). Moreover, the superstructure in question is associated with two actuators (73) to drive it into rotation about the axis of said hinge (77) from and to the winding cylinder (1). Each of said actuators (73) is engaged, on one side, to a rear appendix (78) of a corresponding primary arm (7) and, on the other, to a corresponding appendix (79) of the superstructure (8). In the position (H) of FIG. 1, the superstructure (8) is lifted to a distance from the cylinder (1), so that the cradle of each secondary arm (70) is accessible and a rod (51) can be housed therein. In the position (K) of same FIG. 1, the superstructure (8) is moved down to a position suitable for delimiting the channel (85).

Again with reference to the exemplary embodiment represented in the figures of the attached drawings, the surface (80) forms a lower wall of said superstructure (8) whose head (81) is provided with an elastic and flexible appendix (82) which extends by a preset length towards the underlying rod (51) and results positioned in correspondence of the front section of said channel (85). Upon replacing the reel, the appendix, by entering in contact with the reel in the course of formation, contributes to close the channel (85) frontally and to guide the web towards the unloaded rod. The appendix (82) is advantageously connected to the head (81) of the superstructure (8) via an elastic joint (83) and is provided with a blade (84) in correspondence of a side facing the rod (51), that is, inside the channel (85).

Figure 2:
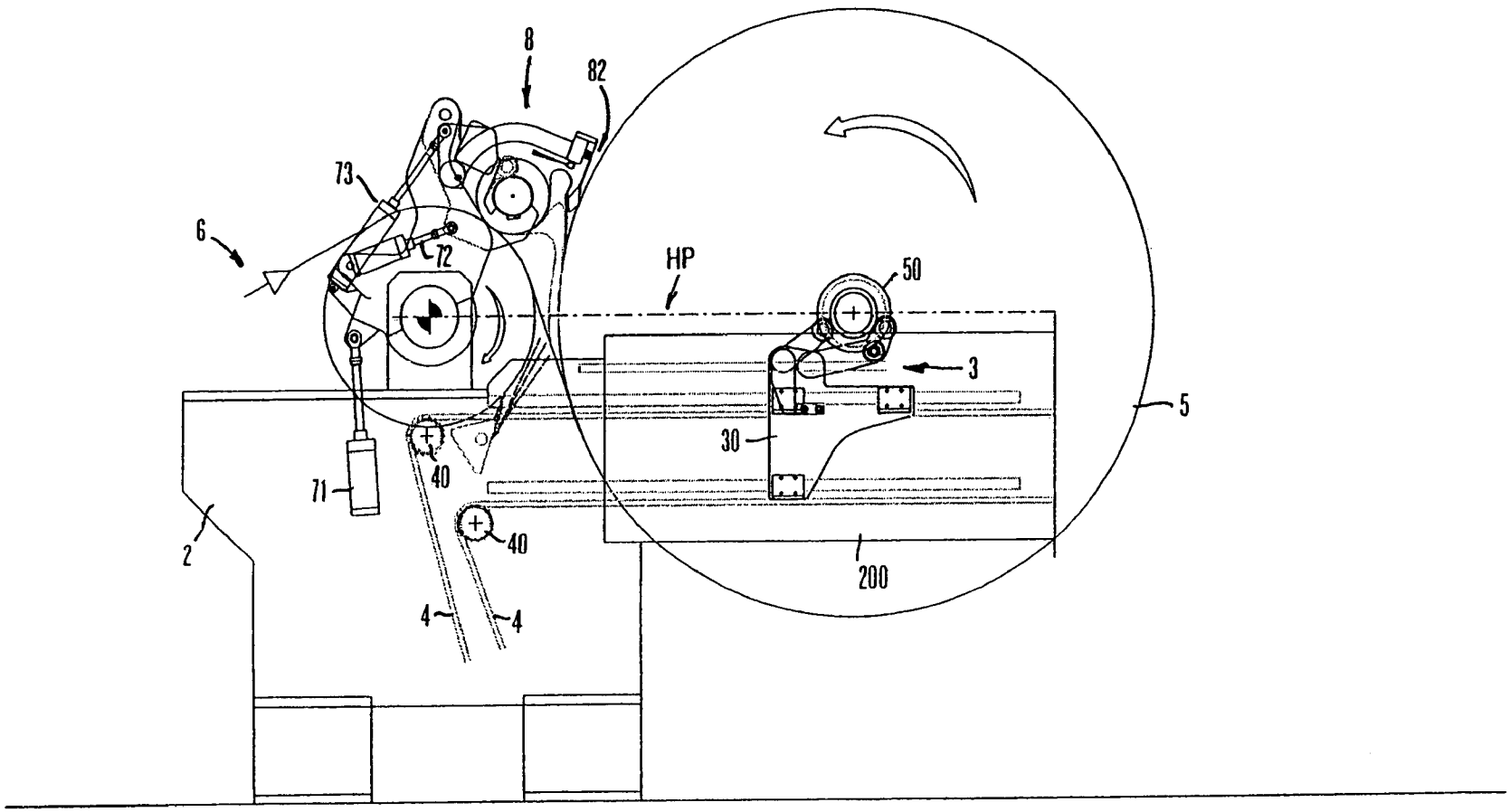
FIG. 2 is a schematic side view in phantom of the apparatus of FIG. 1, which shows a reel-replacing step.

Owing to the flexibility of appendix (82) and to the elasticity of the joint (83), when the apparatus takes up the configuration of FIG. 2, and the reel (5) has such a diameter as to interfere with the same appendix, the latter bends leaning against, and conforming to, the surface of the reel (5), without damaging the wound material, and goes back spontaneously to take its initial configuration when the contact with the reel (5) ceases. Depending on the diameter of the latter, the appendix will come in contact with the reel at different points, but it will be able to accommodate its diameter thanks to its flexibility. The appendix (82) can be made to act as a feeler to control the stopping of the rotation of superstructure (8) upon the transfer thereof from said position (H) to said position (K). Such transfer is activated, in the initial step, by the operator in charge of the machine's operation and is automatically stopped when the appendix (82) comes in contact with the reel (5): this contact causes the appendix (82) to bend towards the rod (51) and, thus, to press a microswitch (800) being positioned, for example, on the head (81) below the joint (83). The impact of the appendix (82) with the surface of the reel (5) will be suitably attenuated by the elasticity of the joint (83).

Advantageously, the apparatus also comprises a second set of nozzles (100) solid to the structure (2) in the space between the cylinder (1) and the region taken by the reel (5) in a position underlying the trajectory followed by the web (6). In other words, the nozzles of the second set (100) result on the opposite side of the nozzles belonging to the first set (9) with respect to the trajectory of material (6), in the space between the cylinder (1) and the reel (5). The nozzles of the second set (100) are intended to produce a corresponding jet of compressed air on the underside of the material (6) downstream of the winding cylinder (1), as described in greater detail later on.

Figure 6:
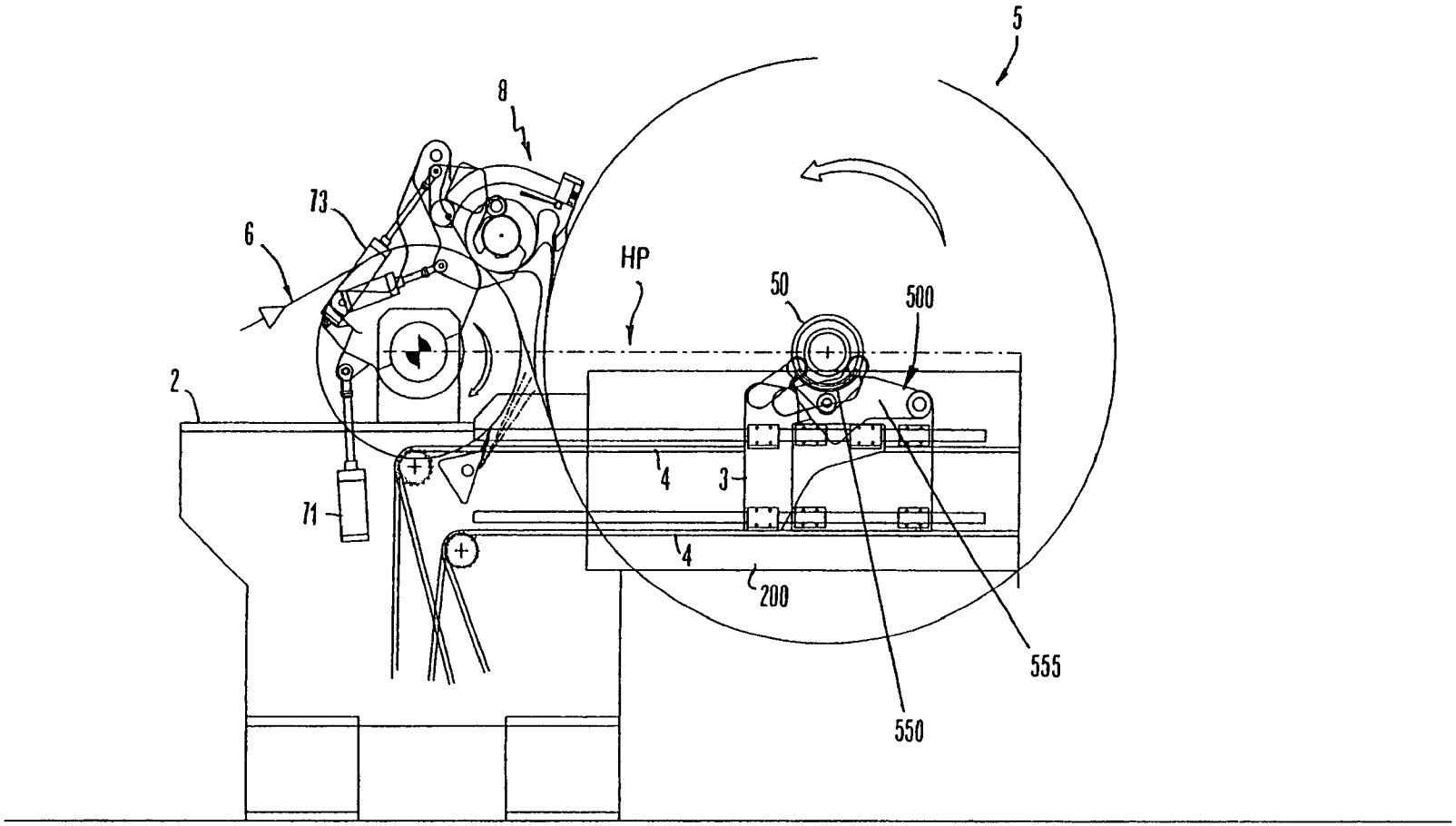
FIG. 6 is a view showing the same machine of FIG. 2 but with a brake for slowing down the reel.

As illustrated in FIG. 6, the apparatus in question can also be provided with a brake (500) to operate, under control, the slowing down of the reel (5) upon the replacement step. For example, the brake (500) may be of shoe-type, with the shoes (550) intended to act onto the two ends of rod (50) and being borne by respective supports (555) horizontally movable like the supports (3) of reel (5) and, like the latter, being engaged to the sides panels (200) of the structure (2).

By way of example, each of said supports (3) may be provided internally of the respective side panel (200), the supports (555) of brake (500) being on the two sides of the side panels, that is, independent of the supports (3). This allows adjusting the position thereof in relation to the diameter of the reel (5) and, thus, to the position of the rod (50).

The operation of the apparatus when replacing the reel, that is, when the reel (5) has reached the desired size, is as follows.

Figure 3:
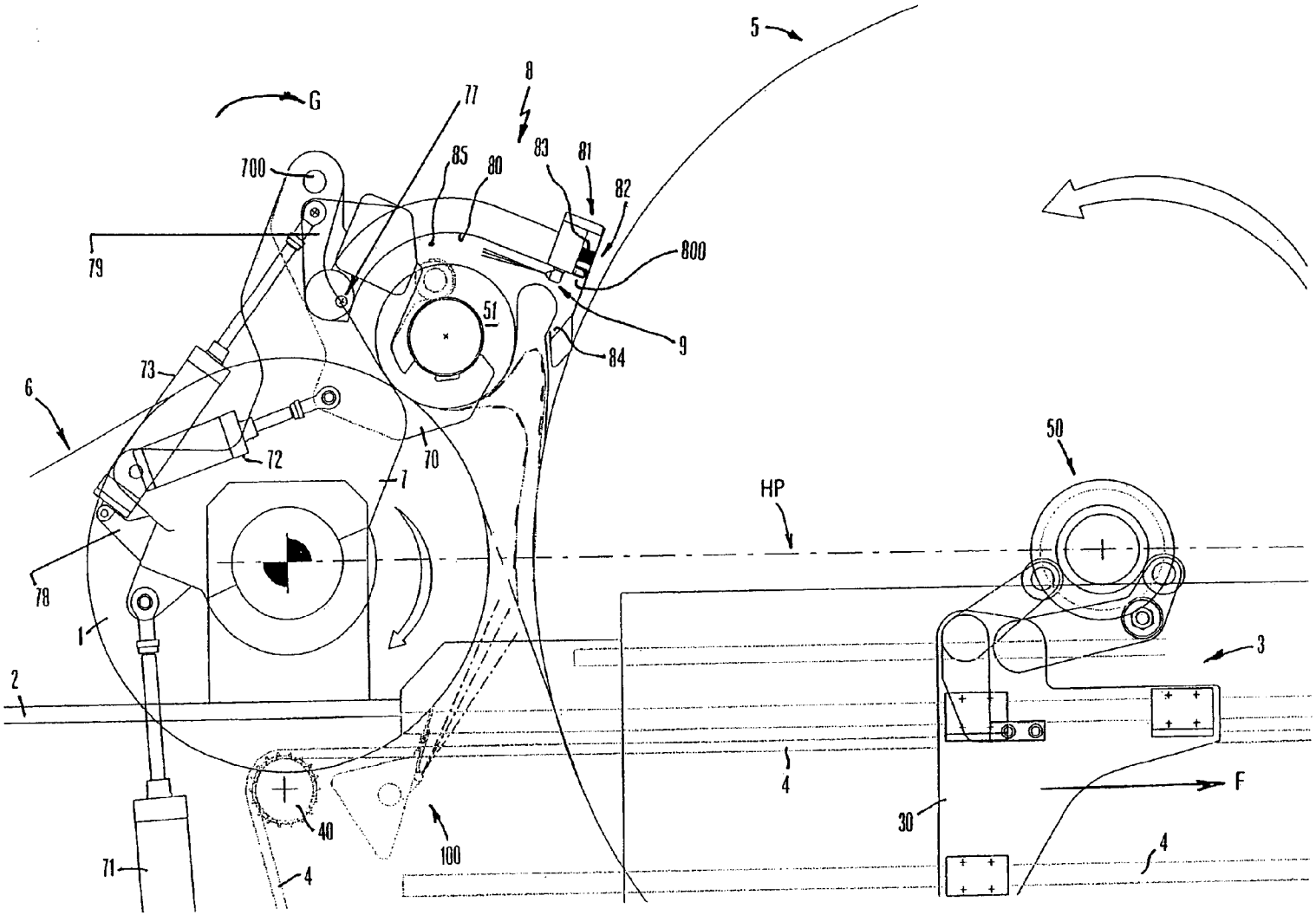
FIG. 3 is an enlarged detail of the apparatus of FIG. 2.
Figure 4:
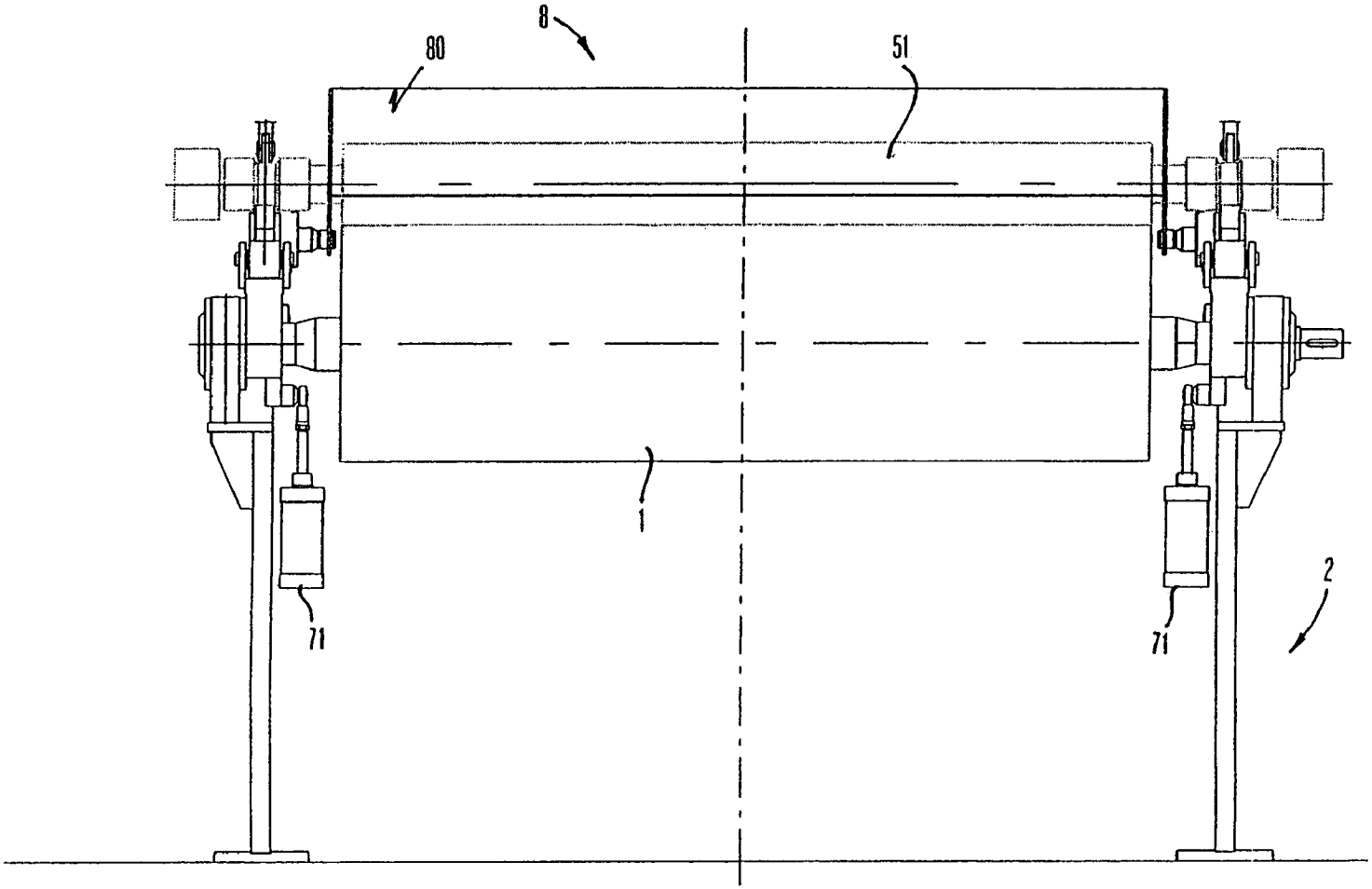
FIG. 4 is a partial rear view, some components being taken away, of the apparatus of FIG. 1.

The supports of the reel (5) are driven so as to move the same reel away from the winding cylinder (1), as indicated by the arrow "F" in FIG. 3, and the arms (7) are rotated as indicated by the arrow "G" so as to bring the rod (51) in contact with the cylinder (1). On the same occasion, the superstructure is moved from the position (h) to the operative position (K). Owing to the difference between the peripheral speed of reel (5)—the latter being slowed down by the braking system (500) which is made to operate when the reel (5) moves out of contact with the cylinder (1)—and the production speed, that is, the feeding speed of the material (6), a pocket of free material is formed in the space between the finished reel (5) and the cylinder (1). At the same time, the nozzles of the second set (100) produce an air jet that inflates from below the paper web (6) by directing it towards the superstructure (8). Moreover, owing to the vacuum generated by the air jet delivered by the nozzles (9), the material is sucked towards the channel (85), that is, into the space between the surface (80) and the rod (51). The cutting system (84), by intercepting the material pushed towards the channel (85), produces a cut that divides the same material. At this point, the material results interrupted, so that one end of it follows the finished reel (5) as this moves away, while the other end is pushed, by the stream produced by the nozzles (9), inside the channel (85) and is made to follow the profile of surface (80) which guides it towards the point of contact—called "nip" in jargon—between the rotating rod (51) and the cylinder (1), so that the same material winds up around the same rod (51). In this way, the reel replacement is carried out, the completed reel (5) being made to move away and a new one beginning to form on the rod (51). As the finished reel (5) is made to move away—while the primary arms (7) continue to rotate driven by the actuators (71)—the secondary arms (70) are driven into rotation by the actuators (72), so that the trajectory of any point of the axis of rod (51) will correspond to a spiral arc, so as to compensate for the progressive increase in the diameter of the reel which begins to form on the rod (51). At the end of rotation of arms (7, 70), the two ends of rod (51) abut against the roller-cradle of a support (3) which, in the meantime, has been moved to the receiving position by the belts (4), as shown in FIG. 5. Upon completion of this step, the arms (7, 70) and the superstructure (8) are moved back to the initial position of FIG. 1. Should the action of blade (84) be insufficient to cause the cutting off of the material (6), or the decision be made not to associate a blade with the appendix (84), the cutting off of the material would take place anyway (6). In fact, in both cases, the material which runs the channel (85) would go all the same into the nip and, as a consequence, would wind up on the rod (51) by causing also the cutting-off.

Figure 7:
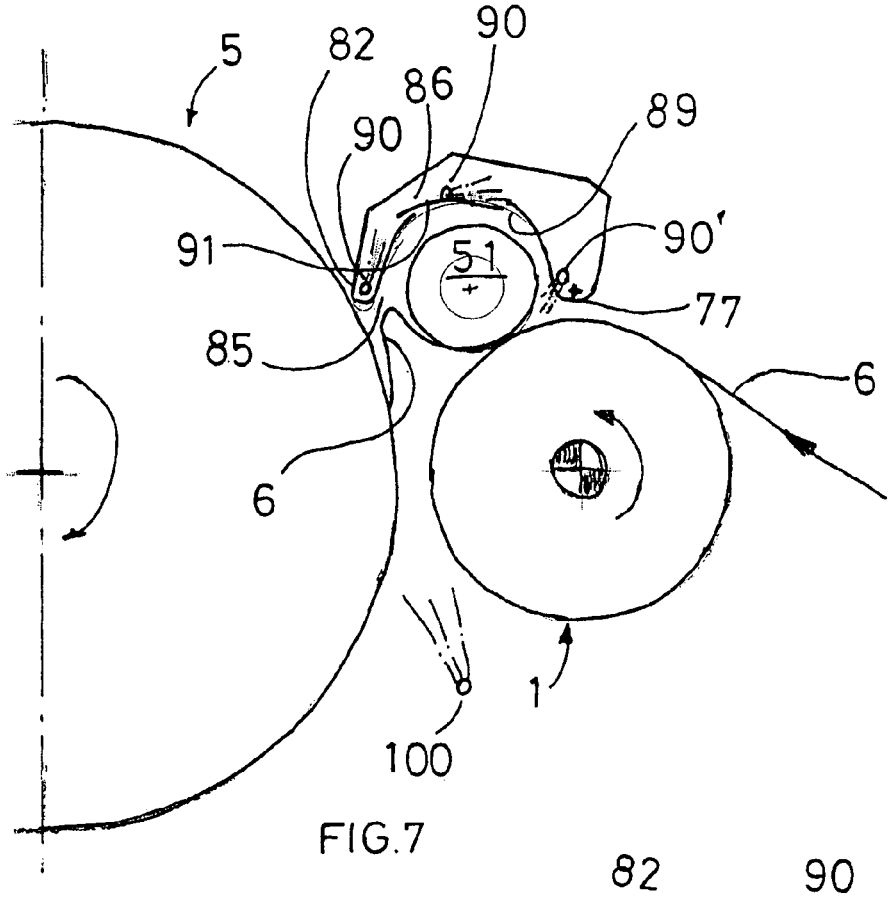
FIG. 7 is a schematic side view of a preferred embodiment of the invention.
Figure 8:
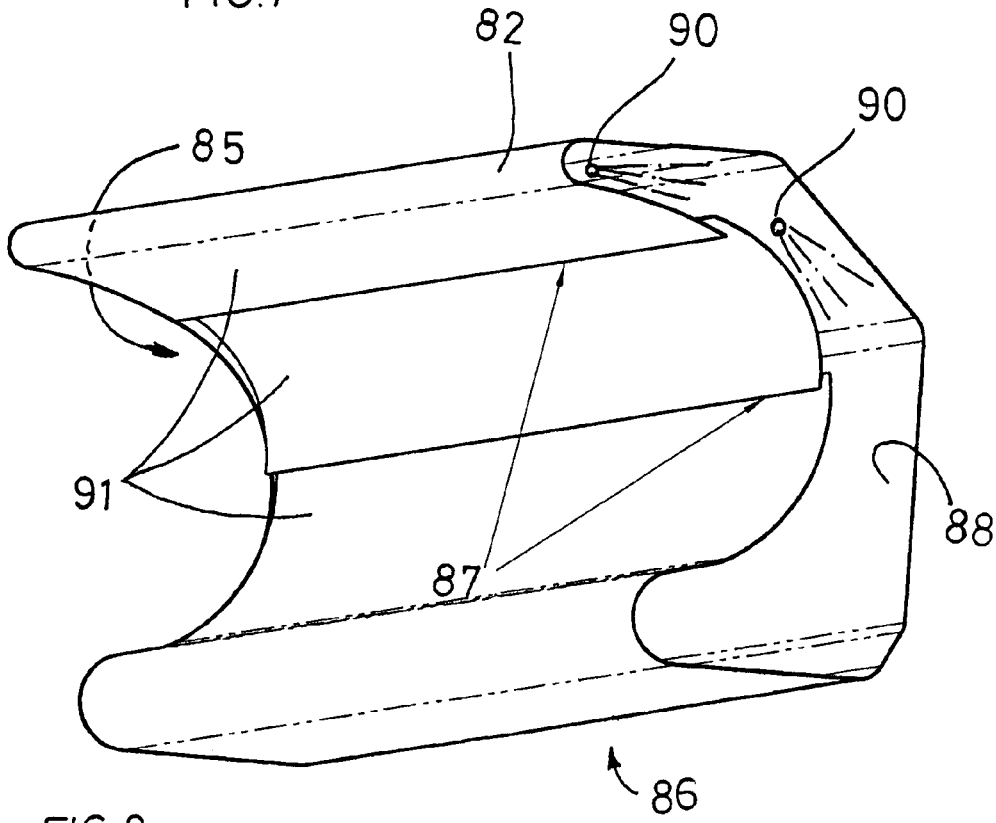
FIG. 8 is a perspective view of a detail of the embodiment of FIG. 7.

With reference to the preferred embodiment of FIGS. 7, 8, the apparatus comprises a box-shaped cap (86) having an interior surface (89) forming the above cited channel (85) with the rod (51).

As best showed in FIG. 8, the surface (89) of cap (86) is formed by a plurality of sections (91) extending longitudinally (i.e. parallel to the rod (51)) and joined each other to form gaps 87 communicating both with the interior and with the exterior of the box shaped cap (86).

In the internal part of cap (86) a number of air nozzles (90) are provided, arranged according longitudinal rows and directed towards the internal surface (88) of the cap (86) opposite to surface (89).

On functioning, the air nozzles (90) create an extra pressure internal to the cap (86) thus causing an air flux to escape from the interior to the exterior through the gaps 87.

According to a further preferred embodiment, the nozzles 90 may be continuously arranged to produce a laminar air jet.

Advantageously, in this embodiment of the invention, at the change of reel, the above described air nozzles (100) first direct the leading portion of web (6) towards the new rod (51) and then, once the web (6) entered the channel (85), the air escaping from gaps (87) forms an air cushion on surface (89) avoiding the web material (6) to adhere to surface (89) and so makes easier its winding on the new rod (51).

Cap (86) may also be provided of further nozzles 90' arranged in the vicinity of the hinge 77 and capable of directing an air jet towards the portion of the web 6 entering the contact region between the winding cylinder (1) and the rod (51).

The motions and controls of the various elements are operable automatically via a programmable electronic control unit of a type known to those skilled in the art and, therefore, will not described herein in detail.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While a specific embodiment of the invention has been shown and described in detail to illustrate the application of the principles of the invention, it will be understood that the invention may be embodied otherwise without departing from such principles.

What is claimed is:

1. An apparatus for reel replacement in a machine for the production of reels of lightweight web material, the apparatus comprising:

a means for winding material onto a tubular core or rod;

a means for feeding an unloaded rod intended to replace a reel;

a surface delimiting, in cooperation with the surface of an unloaded rod, a channel, said surface being movable between a rest or stand-by position and an operative position, said surface comprising an elastic and flexible appendix aligned with a front or inlet section of said channel, said appendix contacting and conforming to a surface of the reel and being movable into an operative position, and being movable back to a stand-by position when the contact with the reel ceases; and a plurality of nozzles producing a jet of air directed at said channel.

2. An apparatus according to claim 1, wherein the channel is of variable cross-section.

3. An apparatus according to claim 1, wherein the surface makes part of a superstructure associated with arms for the support of the unloaded rod.

4. An apparatus according to claim 3, wherein:

the surface comprises an elastic and flexible appendix aligned with a front or inlet section of said channel;

the appendix is elastically engaged with said superstructure.

5. An apparatus according to claim 1, wherein said plurality of nozzles comprises a set of nozzles able to direct a jet of compressed air towards the underside of the material downstream of a winding cylinder.

6. An apparatus according to claim 5, wherein said jet of compressed air contacts said material and forces said material towards said channel, said material therefore attaching to said unloaded core.

7. An apparatus according to claim 1, further comprising a braking system able to slow down a reel that has been wound and is to be replaced.

8. An apparatus according to claim 7, wherein the braking system acts on the axis of the reel.

9. An apparatus according to claim 8, wherein the braking system is horizontally movable for adjusting the position thereof in relation to the diameter of said reel, and in relation to the position of the respective rod.

* * * * *